US005370569A

United States Patent [19]

Mo-Hsin

[11] Patent Number: 5,370,569

[45] Date of Patent: Dec. 6, 1994

[54] SOUND ACTUATED, MAGNETIC, OSCILLATING TOY FIGURE

[76] Inventor: Lin Mo-Hsin, 5th Fl., No. 4, Lane 7, Pao Kao Road, Hsintien, Taipei Hsien, Taiwan, Prov. of China

[21] Appl. No.: 194,396

[22] Filed: Feb. 10, 1994

[51] Int. Cl.[5] ..... A63H 33/26; A63H 29/22; G09F 19/00

[52] U.S. Cl. ..... 446/175; 446/133; 446/484; 40/426

[58] Field of Search ..... 446/129, 133, 139, 175, 446/330, 484; 40/411, 426

[56] References Cited

U.S. PATENT DOCUMENTS

| | | | |
|---|---|---|---|
| 2,115,533 | 4/1938 | Myers | 446/175 |
| 2,348,250 | 5/1944 | Gardner | 40/411 |
| 2,823,323 | 2/1958 | Lamm | 40/426 |
| 3,119,201 | 1/1964 | Brown et al. | 446/175 |
| 3,214,854 | 11/1965 | Swan | 40/411 |
| 4,157,630 | 6/1979 | Sawai | 446/484 |
| 4,727,299 | 2/1988 | Liu | 446/484 |
| 4,852,283 | 8/1989 | Teng | 40/426 |

*Primary Examiner*—Robert A. Hafer
*Assistant Examiner*—Jeffrey D. Carlson
*Attorney, Agent, or Firm*—Bacon & Thomas

[57] ABSTRACT

A voice-controlled ornamental toy includes a rocker supported on a mount above a base by a pivot axle to hold reversed permanent magnets, an electromagnet controlled by a voice actuated control circuit to repulse or attract the reversed permanent magnets causing the rocker to swing an ornament being coupled to the pivot axle by a transmission rod, and a tension spring connected between the rocker and the base to pull the rocker back to its former position when the electromagnet is deenergized.

1 Claim, 6 Drawing Sheets

SOUND ACTUATED, MAGNETIC, OSCILLATING TOY FIGURE

BACKGROUND OF THE INVENTION

The present invention relates to a voice-controlled ornamental toy which is controlled by voices to move an ornament to and fro by means of the effect of magnetic attraction and repulsion.

A variety of voice-acted control circuits have been disclosed and used in moving parts of toys. The effect of magnetic attraction and repulsion has also been widely employed to move parts of toys. The present invention provides a technique to use a voice-acted control circuit in controlling the operation of an electromagnet so as to move a figured ornament.

SUMMARY OF THE INVENTION

The voice-controlled ornamental toy of the present invention comprises a rocker supported on a mount above a base by a pivot axle to hold permanent magnets of opposite polarity orientations, an electromagnet controlled by a voice-actuated control circuit to repulse or attract the opposite permanent magnets for causing the rocker to swing an ornament being coupled to the pivot axle by a transmission rod, and a tension spring connected between the rocker and the base to pull the rocker back to its former position when the electromagnet is deenergized. Because the rocker is moved to and fro by means of the effect of magnetic attraction and repulsion, less friction loss will be produced, and therefore the service life of the toy is prolonged.

DETAILED DESCRIPTION OF THE PREFERRED EMBODIMENT

Figure 1:
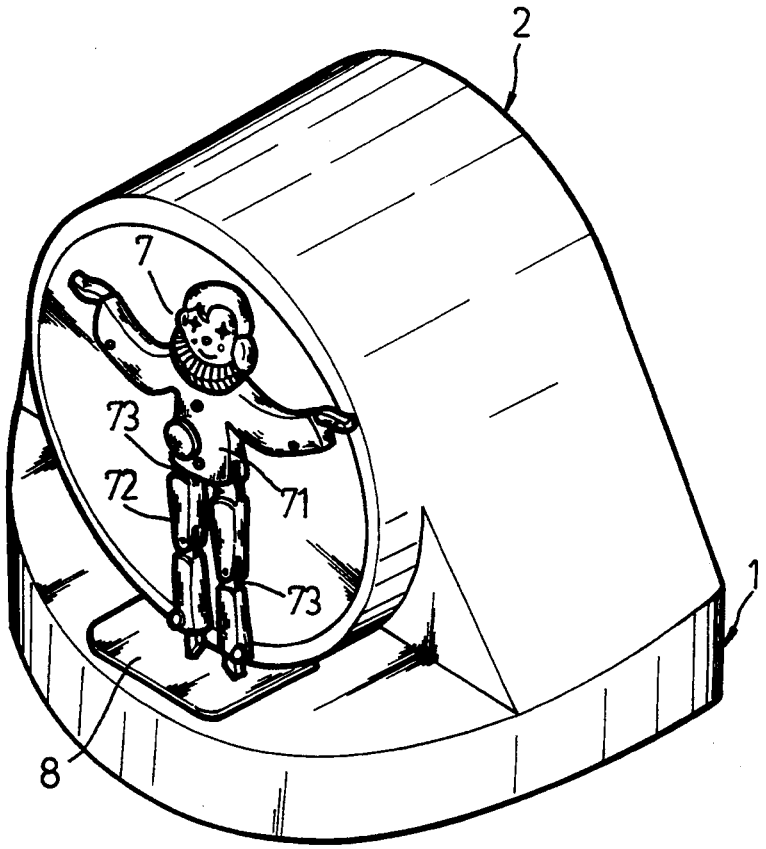
FIG. 1 is an elevational view of a voice-controlled ornamental toy according to the preferred embodiment of the present invention.
Figure 2:
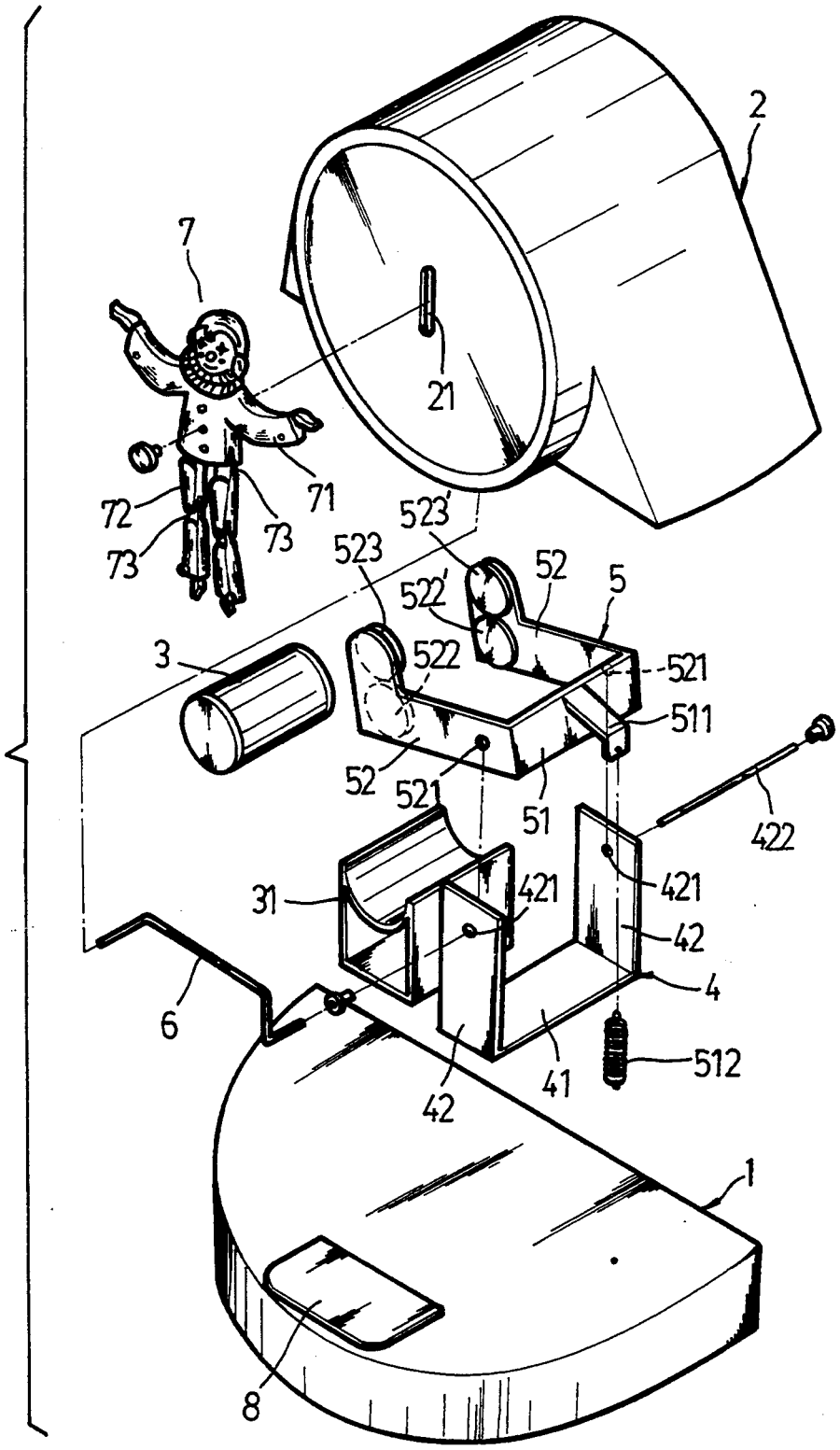
FIG. 2 is an exploded view of the voice-controlled ornamental toy shown in FIG. 1.

Referring to FIGS. 1 and 2, a voice-controlled ornamental toy in accordance with the present invention is generally comprised of a base 1, a shell 2, an electromagnet 3, a mount 4, a rocker 5, a transmission rod 6, and an ornament 7. The shell 2 is mounted on the top of the base 1 for defining a holding space to hold the electromagnet 3, the mount 4, and the rocker 5. A pair of first permanent magnets 522;522' of the same pole relative to the electromagnet 3 and a pair of second permanent magnets 523;523 of the opposite pole relative to the electromagnet 3, are mounted on the two opposite ends of the rocker 5 to act with the electromagnet 3 for causing the rocker to move to and fro, and therefore the ornament 7 is moved by the transmission rod 6. The return motion of the rocker 5 is realized by means of the act of a tension spring 512.

Figure 3:
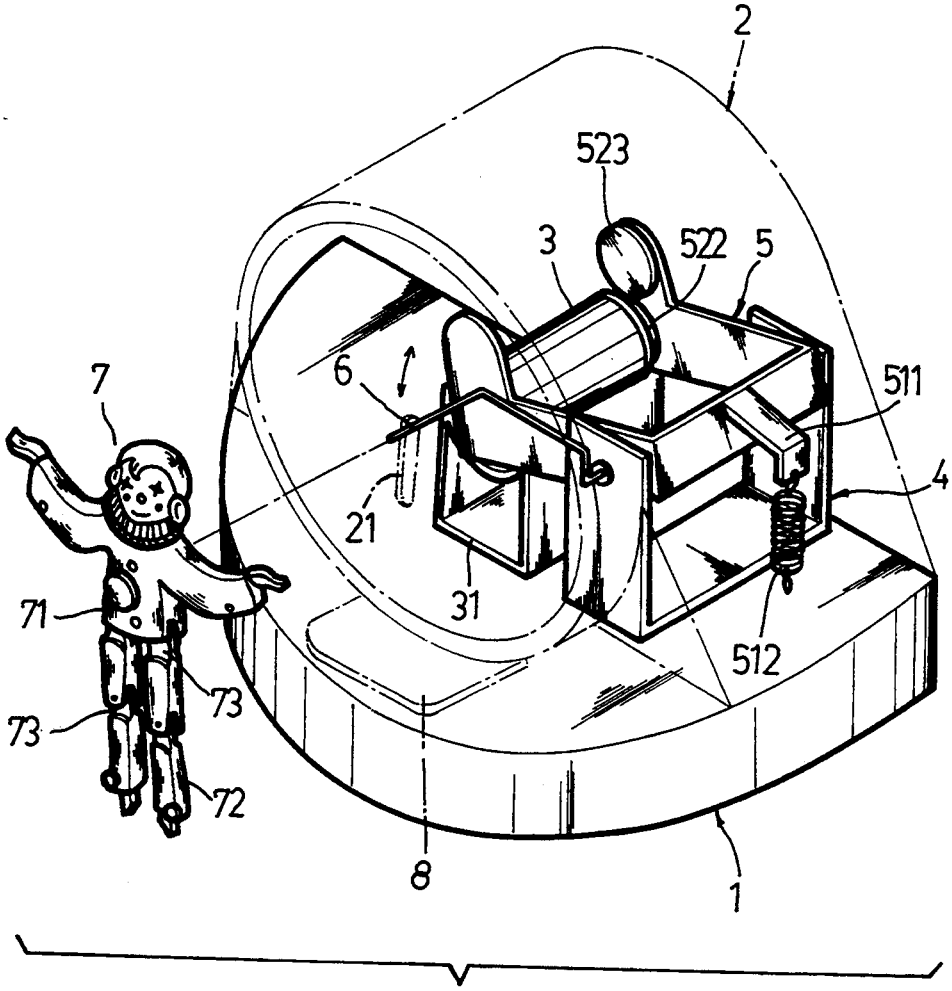
FIG. 3 is a perspective view of the voice-controlled shown in FIG. 1 (showing the movable ornament detached)
Figure 4:
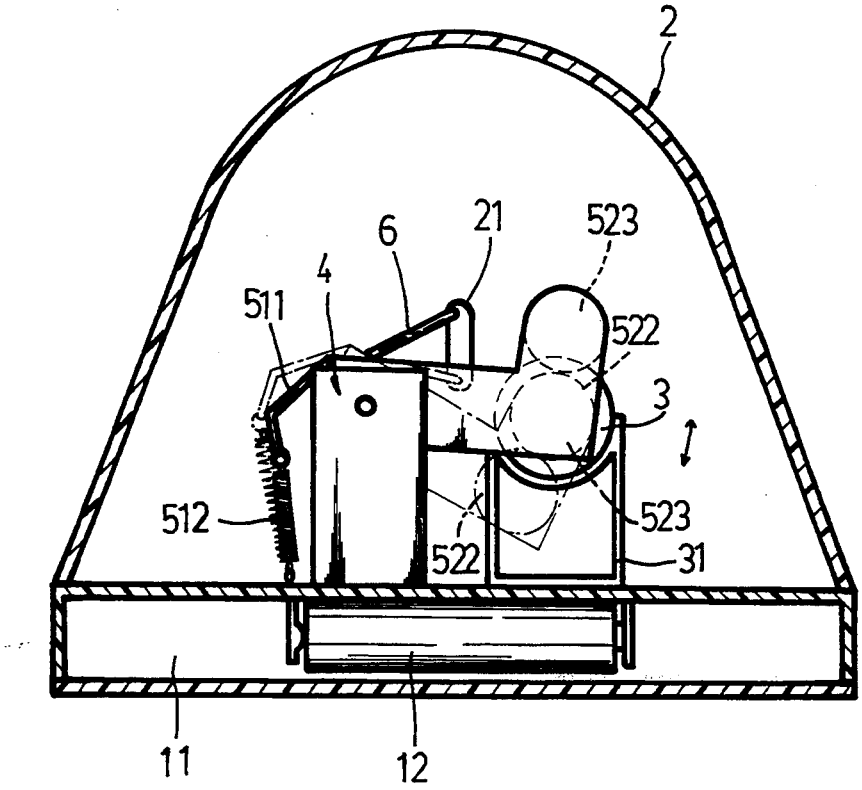
FIG. 4 is a sectional view of the voice-controlled ornamental toy shown in FIG. 1 when operated.

Referring to FIGS. 3 and 4 and FIGS. 1 and 2 again, the base 1 comprises a battery chamber 11 at the bottom, which receives a battery 12. The shell 2 is mounted on top of the base 1 and includes an oblong hole 21 at the center front thereof. The electromagnet 3 is carried on a holder 31 being supported on the base 1 and electrically connected to the battery 12 by a voice-acted control circuit (see FIG. 6). The mount 4 comprises a horizontal wall 41 fastened to the top of base 1 and disposed in parallel with the holder 31, and two upright walls 42 extend from two opposite ends of the horizontal wall 41 and having respective pivot holes 421 aligned with each other. The rocker 5 comprises an elongated middle plate 51, two arms 52 perpendicularly extended from two opposite ends of the elongated middle plate 51 at one side, and a projecting rod 511 extended from the elongated middle plate 51 in the center at an opposite side and connected to one end of the tension spring 512. The arms 52 each have a respective hole 521 near either end of the elongated middle plate 51 and connected to the pivot hole 421 on either vertical wall 42 at an inner side by a pivot axle 422. The pivot axle 422 is affixed to the holes 521 on the rocker 5 and turned in the pivot holes 421 on the mount 4. The pair of first permanent magnets 522;522' are respectively mounted on the free ends of the arms 52 and face either end of the electromagnet 3. The pair of second permanent magnets 523;523' are respectively mounted on the free ends of the arms 52 abutted on either first permanent magnet 522 or 522'. The tension spring 512 has an opposite end fastened to the base 1. The transmission rod 6 has one end coupled to one end of the pivot axle 422 and an opposite end extended out of the shell 2 through the oblong hole 21 and coupled to the ornament 7.

Figure 5:
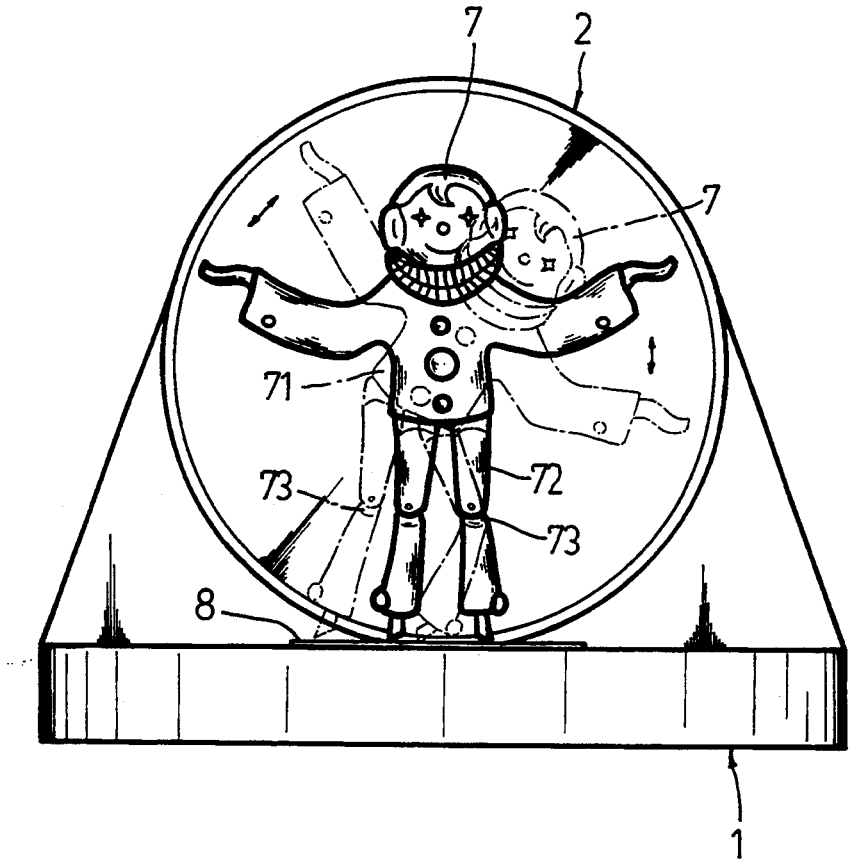
FIG. 5 is a front view of the voice-controlled ornamental toy shown in FIG. 1 when operated.
Figure 6:
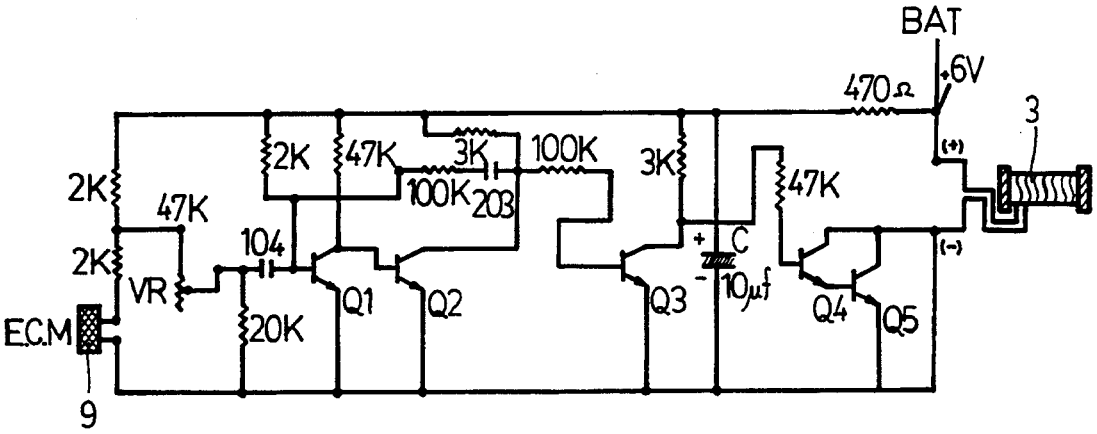
FIG. 6 is a circuit diagram of the voice-acted control circuit of the voice-controlled ornamental toy shown in FIG. 1.

Referring to FIGS. 5 and 6 and FIGS. 3 and 4 again, when external music or voice is received by microphone 9, AC power supply is sent through transistors Q1;Q2 and accumulated in capacitor C, and at the same time transistor Q3 rectifies AC power supply into DC power supply permitting it to be intensified by transistors Q4;Q5 and then sent to the electromagnet 3 causing it energized to produce N and S magnetic poles, so as to repulse the pair of first permanent magnets 522;522' and attract the pair of second permanent magnets 523;523'. When the electromagnet 3 is energized to repulse the pair of first permanent magnets 522;522', the rocker 5 is forced to turn downwards toward the base 1. When the rocker 5 is turned downwards, the electromagnet 3 immediately acts with the pair of second permanent magnets 523;523' to produce a magnetic attraction for causing the pair of second permanent magnets 523;523 to be maintained aligned with the electromagnet 3, and therefore force the rocker 5 and the transmission rod 6 to swing down. On the contrary, when the electromagnet 3 is deenergized (the length of the interval between the action and non-action of the electromagnet 3 is subject to the capacity of the capacitor C), the tension spring 512 immediately pulls the rocker 5 back to its former position. When the rocker 5 is alternatively moved up and down, the movable ornament 7 is oscillated by the transmission rod 6. The ornament may be made of any of a variety of figures, having joints 73 connected between parts 71;72 thereof for allowing the parts oscillated when the movable ornament 7 is moved by the transmission rod 6. Furthermore, an anti-skid pad 8 may be mounted on the base 1 at the bottom of the movable ornament.

What is claimed is:

1. A voice-controlled ornamental toy comprising a base, a shell mounted on a top of said base and having an oblong hole on a front wall thereof, a battery power supply mounted within a battery chamber inside said base, an electromagnet, a mount mounted on said base inside said shell, a rocker supported on said mount, a first permanent magnet means and a second permanent magnet means mounted on said rocker, and a voice-actuated control circuit connected between said battery power supply and said electromagnet and actuated by voice to energize said electromagnet for causing said rocker to swing to and fro, wherein:

said mount comprises a horizontal wall fastened to said base at the top and disposed in parallel with said electromagnet, and two upright walls extending from two opposite ends of said horizontal wall and having a pair of respective pivot holes aligned with each other;

said rocker comprises an elongated middle plate, two arms extending perpendicularly from two opposite ends of said elongated middle plate at one side thereof, and a projecting rod extending from said elongated middle plate at an opposite side thereof and connected to said base by a tension spring means, said arms each having a respective end extending from each end of said elongated middle plate and a respective free end;

the first and second permanent magnet means being mounted on the free ends of the arms in opposite polarity orientations for respective repulsion from and attraction to the electromagnet during its energization;

said pivot axle having one end inserted into the pivot hole on one upright wall of said mount and an opposite end inserted into the pivot hole on the other upright wall of said mount and coupled with a transmission rod, said transmission rod having one end coupled to said pivot axle and an opposite end extending out of the oblong hole on said shell and coupled with a figured ornament being disposed outside said shell; and whereby when said voice-actuated control circuit is triggered by a voice, said electromagnet is energized to repulse said first permanent magnet means and to attract said second permanent magnet means, thereby alternatively causing said rocker to move and swing said figured ornament through said transmission rod, with said tension spring means pulling said rocker back to its former position when said electromagnet is deenergized by said voice actuated control circuit upon disappearance of said voice.

* * * * *